US010464089B2

(12) United States Patent
Goettke

(10) Patent No.: US 10,464,089 B2
(45) Date of Patent: Nov. 5, 2019

(54) DISPENSER FOR LIQUID TO PASTY SUBSTANCES

(71) Applicant: RPC Bramlage GmbH, Lohne (DE)

(72) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 15/757,101

(22) PCT Filed: Sep. 21, 2016

(86) PCT No.: PCT/EP2016/072445
§ 371 (c)(1),
(2) Date: Mar. 2, 2018

(87) PCT Pub. No.: WO2017/050834
PCT Pub. Date: Mar. 30, 2017

(65) Prior Publication Data

US 2018/0169680 A1 Jun. 21, 2018

(30) Foreign Application Priority Data

Sep. 23, 2015 (DE) ..... 10 2015 116 120
Apr. 1, 2016 (DE) ..... 10 2016 105 999

(51) Int. Cl.
*B05B 11/00* (2006.01)

(52) U.S. Cl.
CPC ..... *B05B 11/306* (2013.01); *B05B 11/0029* (2013.01); *B05B 11/0044* (2018.08);
(Continued)

(58) Field of Classification Search
CPC ..... B05B 11/306; B05B 11/3059; B05B 11/0044; B05B 11/3001; B05B 11/0029; B05B 11/3074
See application file for complete search history.

(56) References Cited

U.S. PATENT DOCUMENTS 3,198,403 A * 8/1965 O'Donnell ..... B05B 11/3001 222/321.9
4,384,660 A * 5/1983 Palmisano ..... B05B 11/3059 222/153.07

(Continued)

FOREIGN PATENT DOCUMENTS

DE 10 2009 017 105 A1 10/2009
DE 20 2014 103 984 U1 6/2015

(Continued)

OTHER PUBLICATIONS

International Search Report of PCT/EP2016/072445, dated Dec. 16, 2016.

(Continued)

*Primary Examiner* — David P Angwin
*Assistant Examiner* — Bob Zadeh
(74) *Attorney, Agent, or Firm* — Collard & Roe, P.C.

(57) ABSTRACT

A dispenser for liquid to pasty substances has a dispenser head and a dispenser body. The dispenser head is movable relative to the dispenser body in a displacement direction for carrying out a pumping movement and is also rotatable relative to the dispenser body. The dispenser has a pump chamber having an inlet valve and an outlet valve. A dispensing tube is provided and is divided into two portions which can move relative to each other and which, as a result, can be moved into a closed position in which the substance cannot be dispensed and into an open position in which the substance can be dispensed. The portions, in order to change between the closed position and the open position, can be moved relative to each other without a relative movement in the displacement direction.

8 Claims, 19 Drawing Sheets

(52) U.S. Cl.
CPC ..... *B05B 11/3001* (2013.01); *B05B 11/3059* (2013.01); *B05B 11/3074* (2013.01)

(56) References Cited

U.S. PATENT DOCUMENTS

| | | | | |
|---|---|---|---|---|
| 5,899,363 | A | 5/1999 | Bliss, III et al. | |
| 8,439,230 | B2 | 5/2013 | Hagen | |
| 2004/0084481 | A1* | 5/2004 | Foster | B05B 7/0031 222/190 |
| 2007/0194050 | A1 | 8/2007 | Krampen et al. | |
| 2009/0008413 | A1* | 1/2009 | Choi | A45D 34/04 222/256 |
| 2009/0028734 | A1* | 1/2009 | Tseng | B05B 11/3023 417/554 |
| 2011/0174840 | A1* | 7/2011 | Law | B05B 11/3001 222/153.13 |
| 2017/0036226 | A1 | 2/2017 | Goettke | |
| 2018/0169680 | A1* | 6/2018 | Goettke | B05B 11/0029 |

FOREIGN PATENT DOCUMENTS

| | | | |
|---|---|---|---|
| EP | 1 815 914 | A1 | 8/2007 |
| EP | 1 884 290 | A1 | 2/2008 |
| WO | 2004/071673 | A1 | 8/2004 |

OTHER PUBLICATIONS

Response to European Patent Office by German Patent Attorney regarding PCT/EP2016/072445 dated Jul. 24, 2017 with an English translation of the relevant parts.

* cited by examiner

DISPENSER FOR LIQUID TO PASTY SUBSTANCES

CROSS REFERENCE TO RELATED APPLICATIONS

This application is the National Stage of PCT/EP2016/072445 filed on Sep. 21, 2016, which claims priority under 35 U.S.C. § 119 of German Application No. 10 2015 116 120.6 filed on Sep. 23, 2015 and German Application No. 10 2016 105 999.4 filed on Apr. 1, 2016, the disclosures of which are incorporated by reference. The international application under PCT article 21(2) was not published in English.

TECHNICAL FIELD

The invention pertains to a dispenser for liquid to pasty substances with a dispenser head and a dispenser body, wherein the dispenser head is movable relative to the dispenser body in a displacement direction in order to carry out a pumping motion, as well as rotatable relative to the dispenser body, wherein the dispenser furthermore features a pump chamber with an inlet valve and an outlet valve, wherein a dispensing tube is arranged downstream of the outlet valve in a dispensing direction of the substance and said dispensing tube is divided into two sections, which can be moved relative to one another and, as a result of a motion relative to one another, transferred into a closed position, in which the substance cannot be dispensed, and into an open position, in which the substance can be dispensed, wherein the sections are nested in one another at regions that face one another in order to form an inner part and an outer part, wherein a seal can be produced between an outer wall of the inner part and an inner wall of the outer part, and wherein the sections can be moved relative to one another without a relative motion in the displacement direction in order to change between the closed position and the open position.

PRIOR ART

Dispensers of the type in question are known. In this context, we refer, for example, to publication DE 10 2009 017 105 A1.

DE 20 2014 103 984 U1 discloses a dispenser, in which a dispensing tube can be moved into a closed position or an open position due to a rotation relative to a receptacle part. The receptacle part is rigidly connected to the dispenser housing.

EP 1 815 914 A1 discloses a dispenser, in which a seal of a ventilation channel for the reservoir is produced in the idle position of the metering device. With respect to the prior art, we furthermore refer to EP 1 884 290 A1, U.S. Pat. No. 5,899,363 A and WO 2004/071673 A1.

SUMMARY OF THE INVENTION

Based on the above-described prior art, the invention aims to disclose a dispenser for liquid to pasty substances that can be advantageously transferred into a closed position, in which the substance cannot be dispensed, and an open position, in which the substance can be dispensed. The invention furthermore aims to realize an advantageous ventilating option on a dispenser for liquid to pasty substances.

According to another inventive idea, the objective of the invention is initially attained in that a first section carries the pump piston on its bottom side and is guided in the pump chamber such that it is non-rotatable relative to the dispenser, but displaceable in the axial direction.

According to another object, the ventilation opening is shut as a result of the circumferential contact of a dispenser body section with an opposite sealing section of the dispenser head similar to a lip seal.

The initially cited solution can also be described to the effect that, when the dispenser rests on a horizontally aligned supporting plane, the sections can be moved relative to one another without a relative motion in a vertical direction in order to change between the closed position and the open position.

As a result of the proposed design, the change between the open position and the closed position can be realized without a relative motion between the dispensing tube sections at least along a longitudinal dispenser axis or a dispenser head axis, respectively. The displacement of one section along the axis may result in a coupled motion of the other section in the same direction.

In another preferred embodiment, it is proposed that the sections can only be rotationally moved relative to one another in order to change between the two positions, particularly about a dispenser axis or the aforementioned displacement direction if it is assumed to be arranged centrally. The dispenser axis extends vertically if a supporting plane is aligned horizontally. Due to the ability to rotate the sections relative to one another, particularly the regions of the sections that are nested in one another can be moved into a position relative to one another, in which unblocked flow-through openings can fluidically connect the dispensing tube sections to one another.

In order to ventilate the container interior during the course of a substance discharge, a ventilation opening, through which air can be drawn in from the surroundings, may be provided in the dispenser, particularly in the cooperating region between the dispenser head and the dispenser body. This ventilation opening is preferably shut in the closed position and, in particular, in a delivery position of the dispenser. The seal can be produced as a result of the cooperation between sections of the dispenser head and sections of the dispenser body. In this context, a cooperation similar to a sealing lip may be realized.

In order to allow the pumping motion, the dispenser head may be movable between an extended position and a retracted position in the described vertical direction or in the described displacement direction, respectively. During a displacement of the dispenser head in the direction of the extended position, a pump chamber can preferably be filled with the substance due to the vacuum acting thereupon. The substance is then discharged from the pump chamber through the dispensing tube during the course of the displacement of the dispenser head in the direction of the retracted position.

The dispenser head may be spring-loaded in the direction of the extended position. The spring force may be generated due to the material properties of the cooperating elements and/or by a separate spring.

The mobility between the extended position and the retracted position can preferably be blocked in the closed position. In addition to the preferred seal between the sections of the dispensing tube, the mobility of the dispenser head along the dispenser axis is at the same time also blocked in such a closed position. The dispenser head is therefore unable to carry out a pumping motion.

The closed position may be assumed in the extended position of the dispenser head. The closed position may alternatively or additionally also be assumed in the retracted position.

The extended position and the retracted position are preferably defined as a result of the formation of a limit stop. In an embodiment, the closed position can also be assumed in this respective displacement position of the dispenser head.

The mobility of the dispenser head along the dispenser head axis may be blocked due to the cooperation between projections on the dispenser head and on the dispenser body or between projection-like elements on the one hand and recesses accommodating the projections on the other hand.

BRIEF DESCRIPTION OF THE DRAWINGS

The invention is described in greater detail below with reference to the attached drawings that, however, merely show an exemplary embodiment. A component, which is described with reference to one of the exemplary embodiments and not replaced with a different component in another exemplary embodiment, is therefore also described as a potentially existing component in this other exemplary embodiment. In the respective drawings.

DESCRIPTION OF THE EMBODIMENTS

Figure 1:
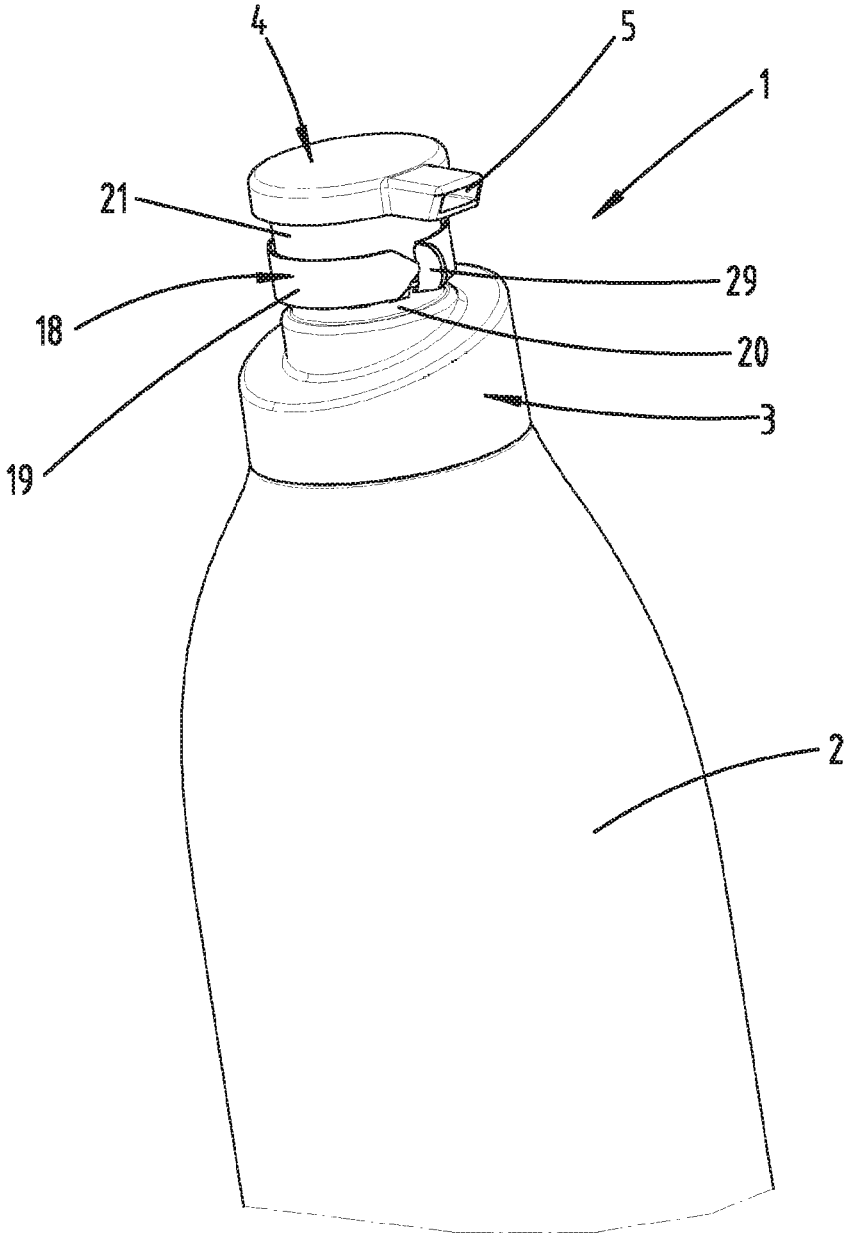
FIG. 1 shows a perspective representation of a dispenser with a dispenser head in a tamper-evident closed position.
Figure 2:
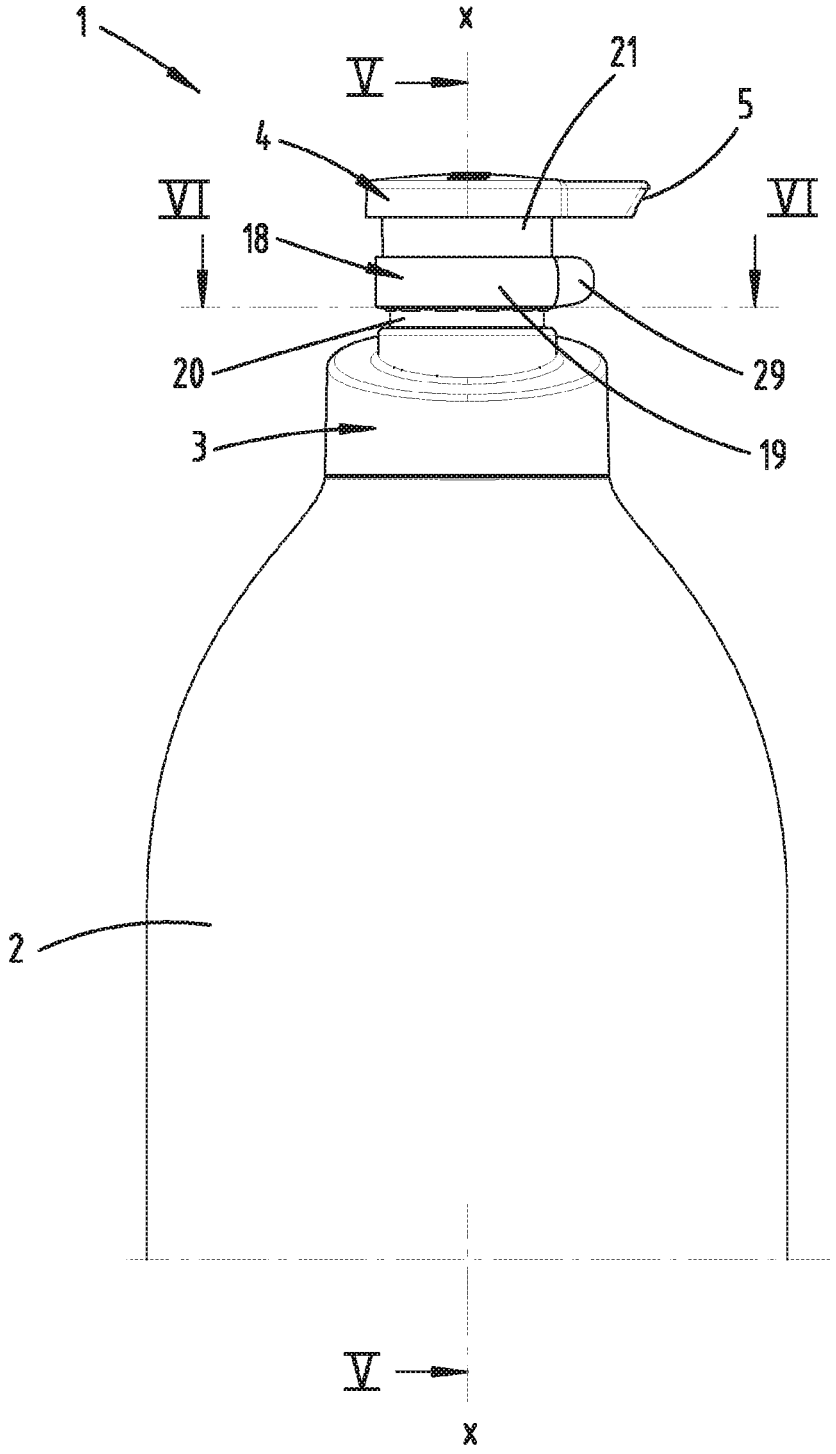
FIG. 2 shows a side view of the dispenser in the position according to FIG. 1.
Figure 3:
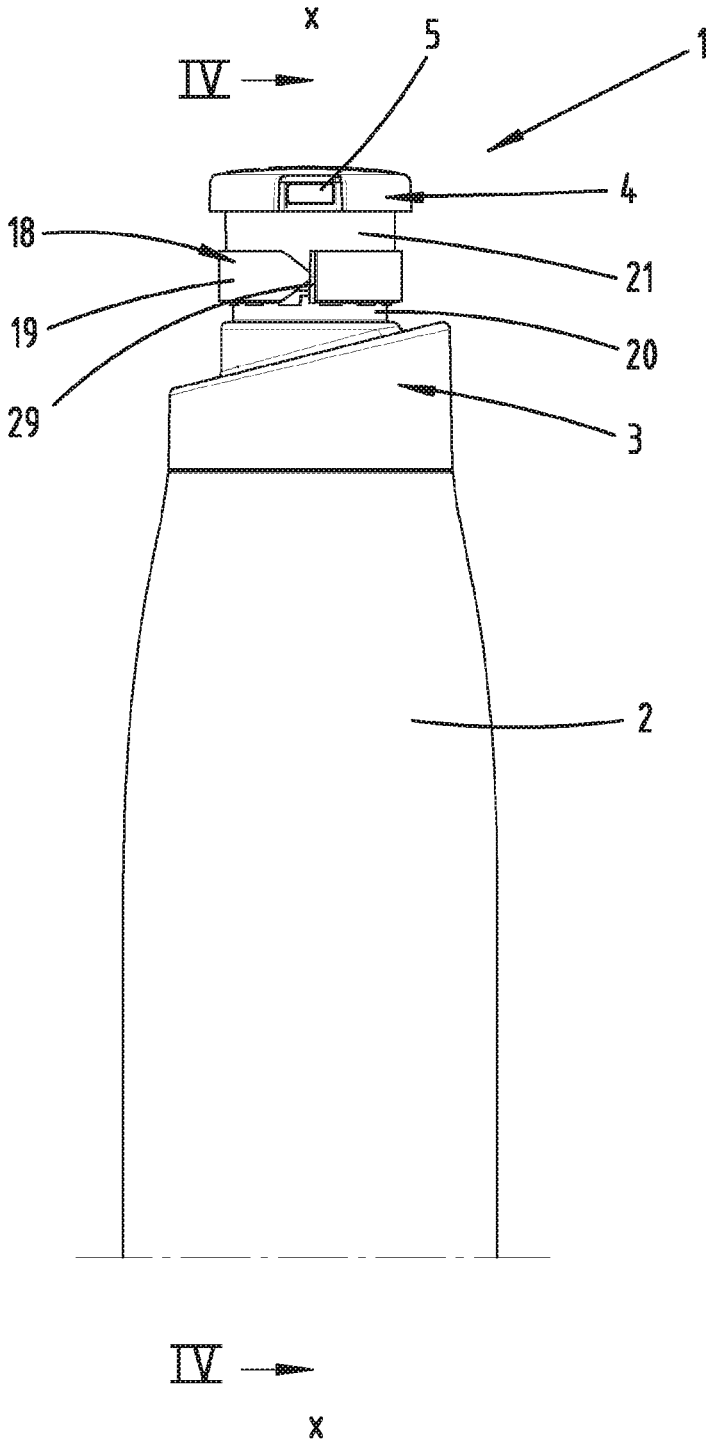
FIG. 3 shows a front view of the dispenser according to FIG. 1 and FIG. 2.

A first embodiment of a dispenser 1 for liquid to pasty substances is initially described below with reference to FIGS. 1-16.

The dispenser 1 essentially comprises a dispenser body 3, which can be arranged, particularly screwed, on a container 2, as well as a dispenser head 4 with a dispensing opening 5.

In order to dispense the substance stored in the container 2, the dispenser head 4 can be displaced between an extended position and a retracted position perpendicular to a horizontally aligned supporting plane, on which the dispenser 1 can rest. The displacement position is identified by the reference symbol V; see for example FIG. 14. This makes it possible to carry out a pumping motion, wherein the substance is discharged through the dispensing opening 5 in the retracted position of the dispenser head 4, i.e. in its lowered position, and the substance is drawn from the container 2 into a pump chamber 6 during the course of the displacement of the dispenser head 4 into the extended position.

The pump chamber 6 is fluidically arranged between the inlet valve 7 and the outlet valve 8.

The inlet valve 7 is preferably formed on the side of the dispenser body. A substance suction tube 9 may be connected to the inlet valve 7 on the side facing away from the pump chamber 6.

A pump piston 10 adjoins the inner side of the pump chamber wall 30 enclosing the pump chamber 6 in a sealed fashion. The pump piston 10 is connected to the dispenser head 4 by the wall of a dispensing tube 11, which essentially extends coaxial to the dispenser axis x, and can be displaced between the extended position and the retracted position of the dispenser head 4 by means of the dispenser head 4.

The dispenser head 4 can be moved relative to the stationary dispenser body 3 along the dispenser axis x, as well as in the circumferential direction about the dispenser axis x.

The dispensing tube 11 is essentially divided into two parts and therefore composed, in particular, of two tubular sections 12 and 13 that can be moved relative to one another. The section 13 preferably carries the pump piston 10 on its bottom side and is furthermore preferably guided in the pump chamber 6 such that it is non-rotatable relative to the dispenser body 3, but displaceable in the axial direction. The rotational blocking may be achieved, for example, by means of a vertical rib that is formed on an outer wall of the section 13 and vertically movable in a corresponding groove of the pump chamber wall 30.

The section 12 is connected to the dispenser head 4 in a rotationally rigid fashion. A displacement of the dispenser head 4 in the direction of the dispenser axis x results in the coupled motion of the section 13 featuring the pump piston 10 over the section 12.

The facing regions of the sections 12 and 13 are nested in one another. The end section of the section 12, which penetrates into the section 13, forms flow-through openings 14 that extend outward radially to the dispenser axis x and are connected to the centrally arranged dispensing tube 11.

The outlet valve 8 is formed in the region of a base 15 that separates the pump chamber 6 from the dispensing tube 11. The base 15 preferably is part of the section 13 and furthermore preferably forms the piston head.

The dispensing tube 11 transforms into a discharge channel 16, which is essentially oriented radially to the dispenser axis x and ends in the dispensing opening 5.

The dispenser head 4 can be displaced relative to the dispenser body 3 along the dispenser axis x and is in this case supported on the dispenser body 3 by means of a spring 17, particularly a pressure spring. The dispenser head 4 is spring-loaded in the direction of an extended position by means of the spring 17, which in the exemplary embodiment is realized in the form of a separate cylindrical pressure spring.

The dispenser head 4 can furthermore be rotated relative to the dispenser body 3 about the dispenser axis x, particularly by 90 degrees, from a closed position into an open position and vice versa.

Figure 17:
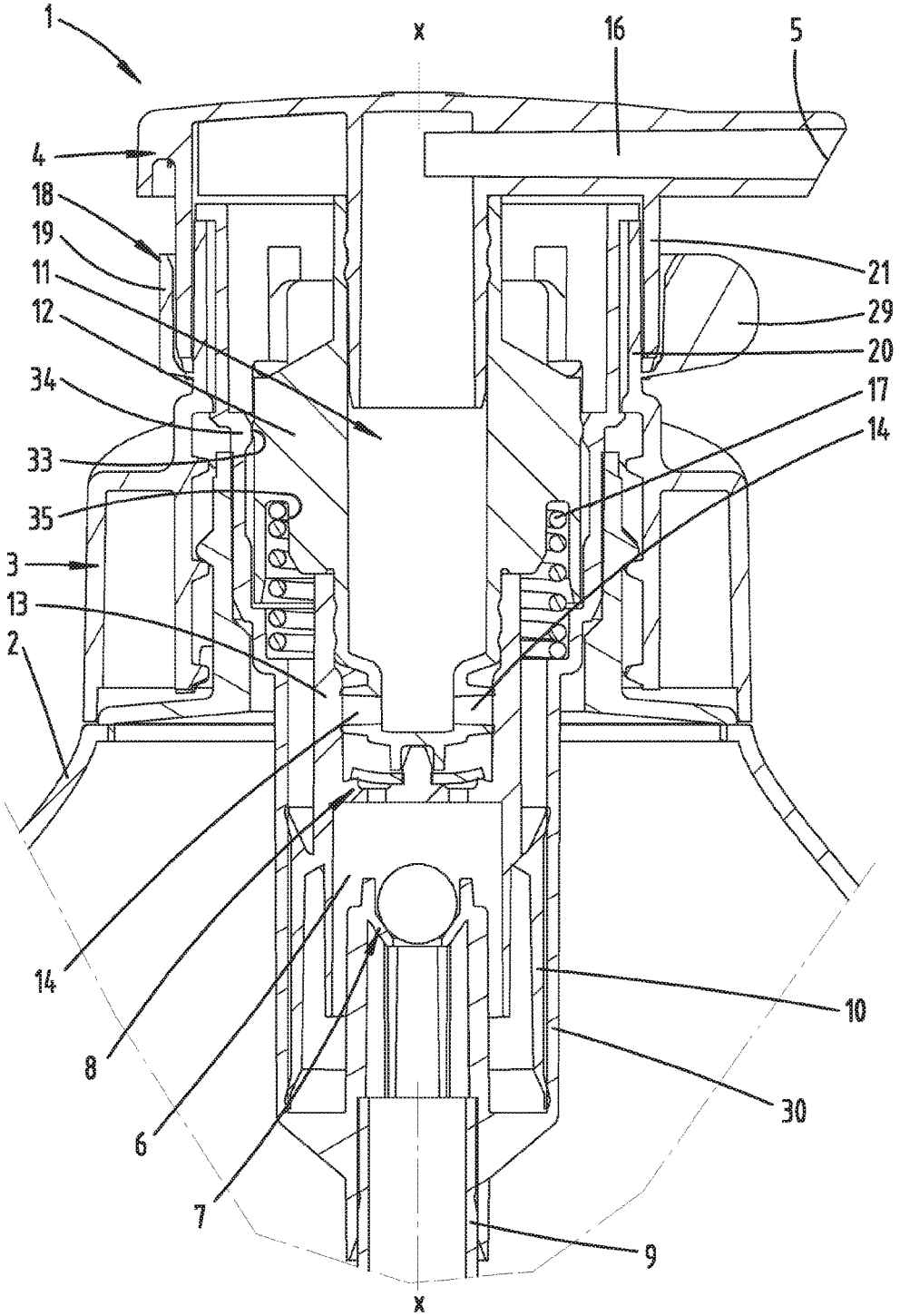
FIG. 17 shows a sectional representation according to FIG. 4 concerning a second embodiment.
Figure 18:
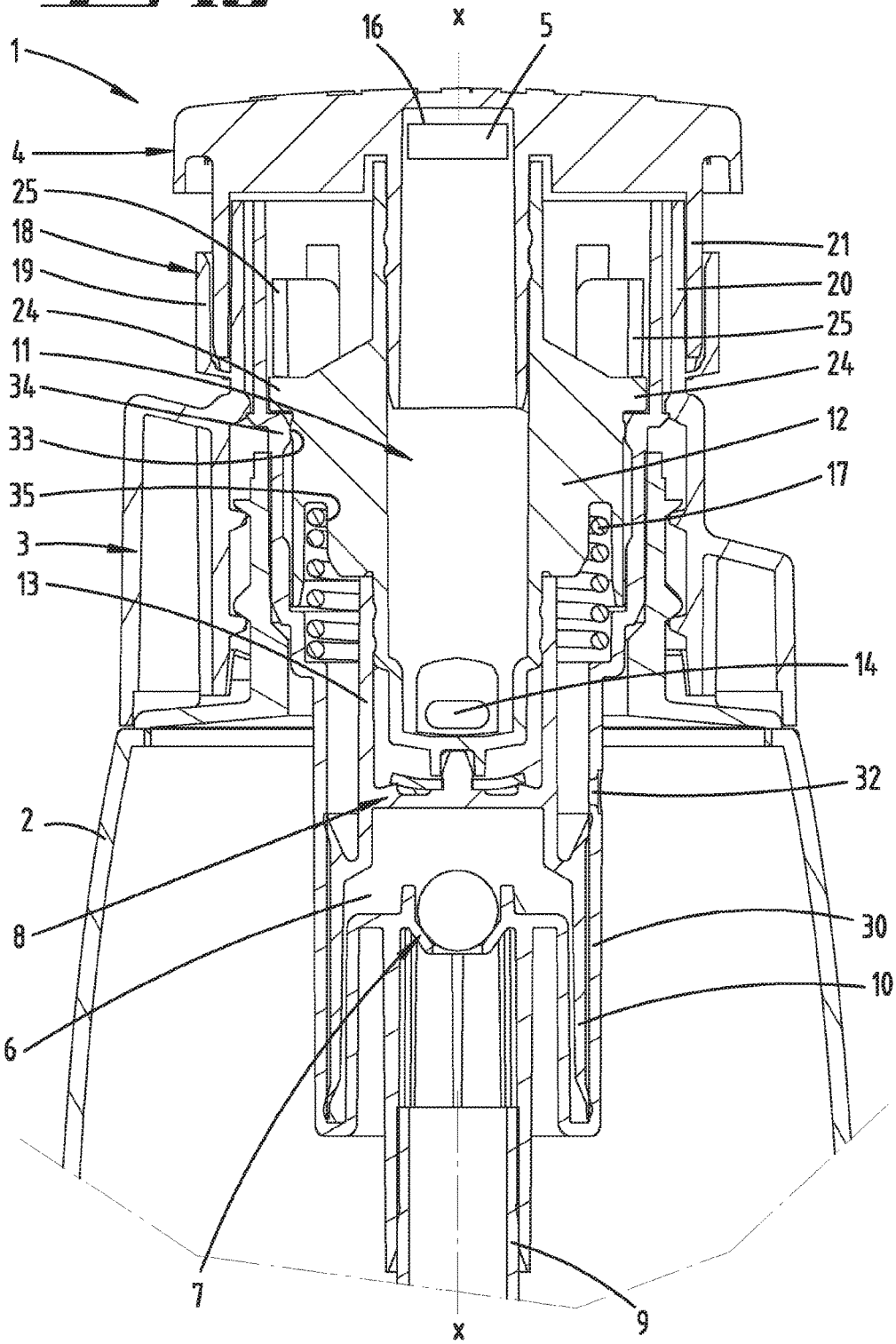
FIG. 18 shows the second embodiment in the form of a sectional representation according to FIG. 5.

The closed position in the retracted position of the dispenser head. 4, which is illustrated in the first embodiment according to FIGS. 1-6, as well as in the second embodiment according to FIGS. 17 and 18, preferably is the delivery position prior to an initial use of the dispenser 1. This delivery position may be secured by means of a tamper-evident seal 18.

In the exemplary embodiment shown, the tamper-evident seal 18 is realized in the form of a tamper-evident ring 19, which circumferentially encloses the outer side of a dispenser head neck 21, which telescopically cooperates with a dispenser body neck 20, underneath the dispensing opening 5.

The tamper-evident ring 19 is connected to the dispenser body 3 by means of material bridges 22 that are uniformly distributed over the circumference, preferably as a result of realizing the tamper-evident ring 19 and the dispenser body 3 in one piece and of the same material.

The material bridges 22 are realized in a web-like fashion and in the embodiments illustrated in FIGS. 1-18 simultaneously form interlocking projections 31, which are spaced apart from one another in the circumferential direction.

The facing peripheral edge of the dispenser head neck 21 engages into the intermediate spaces between two circumferentially adjacent interlocking projections 31 with axially oriented interlocking recesses 23.

When the tamper-evident ring 19 is attached to the dispenser body 3, the dispenser head 4 is therefore prevented from rotating as a result of the interlock between the interlocking recesses 23 and the interlocking projections 31.

In this lowered closed position, which can also be reassumed after the removal of the tamper-evident seal 18, the dispenser head 3 is secured in the retracted position. This is achieved in that locking shoulders 24, which protrude radially outward from the outer side of the dispensing tube section 12, engage in this closed position underneath locking sections 25 of the dispenser body 3, which protrude radially inward. In this position, the dispenser head 4 cannot be displaced into the extended position.

Figure 4:
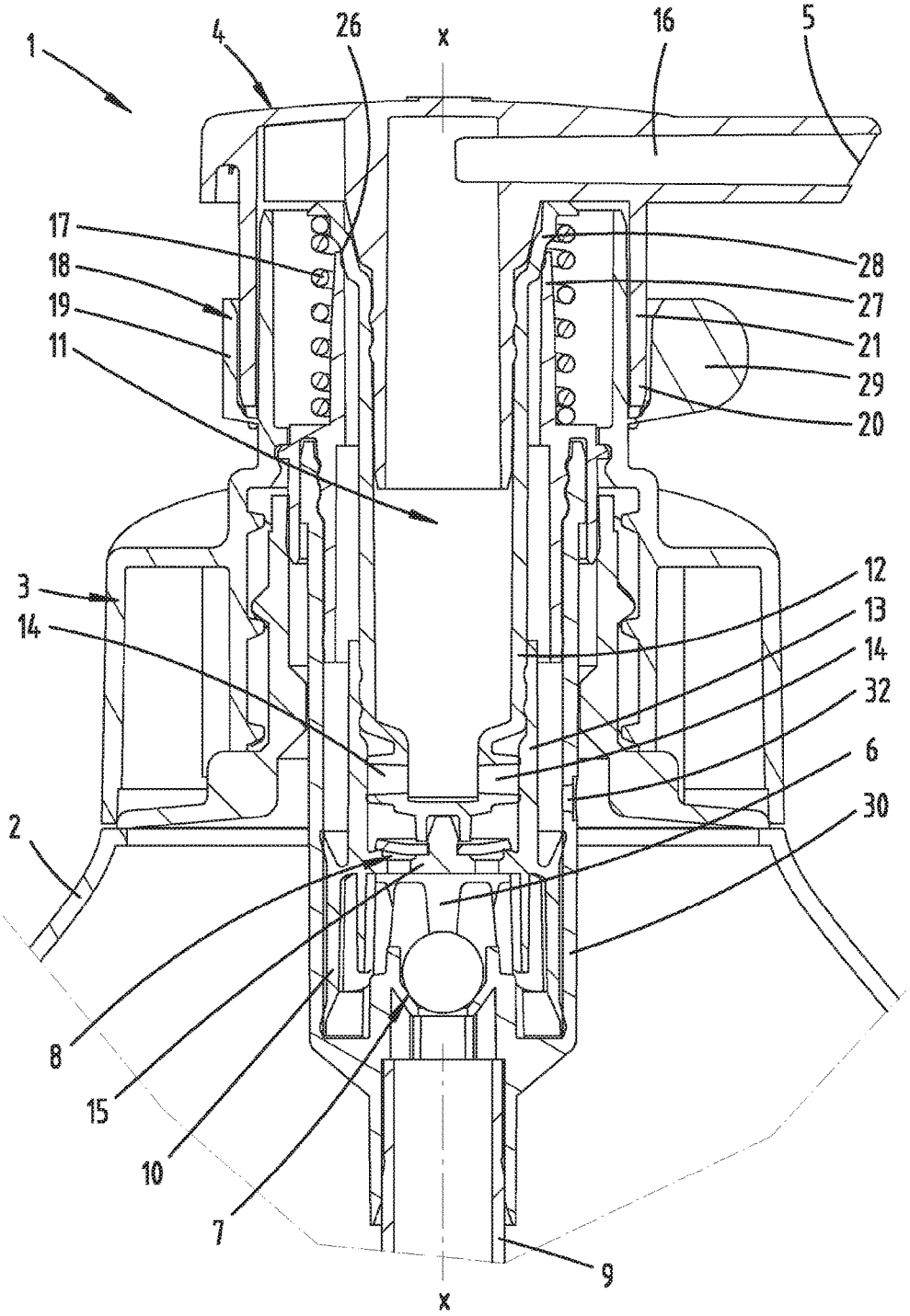
FIG. 4 shows the section along the line IV-IV in FIG. 3.
Figure 5:
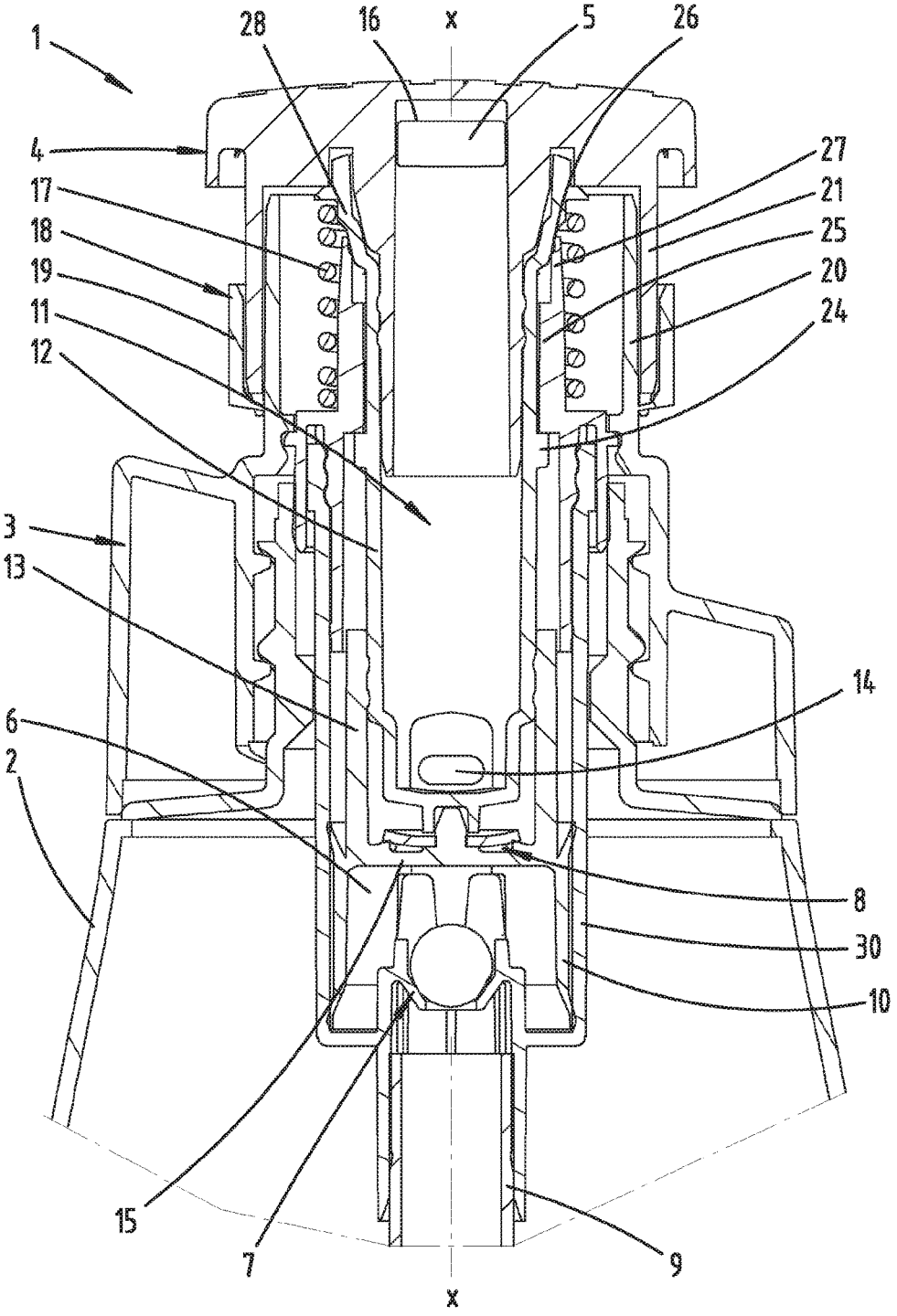
FIG. 5 shows the section along the line V-V in FIG. 2.
Figure 6:
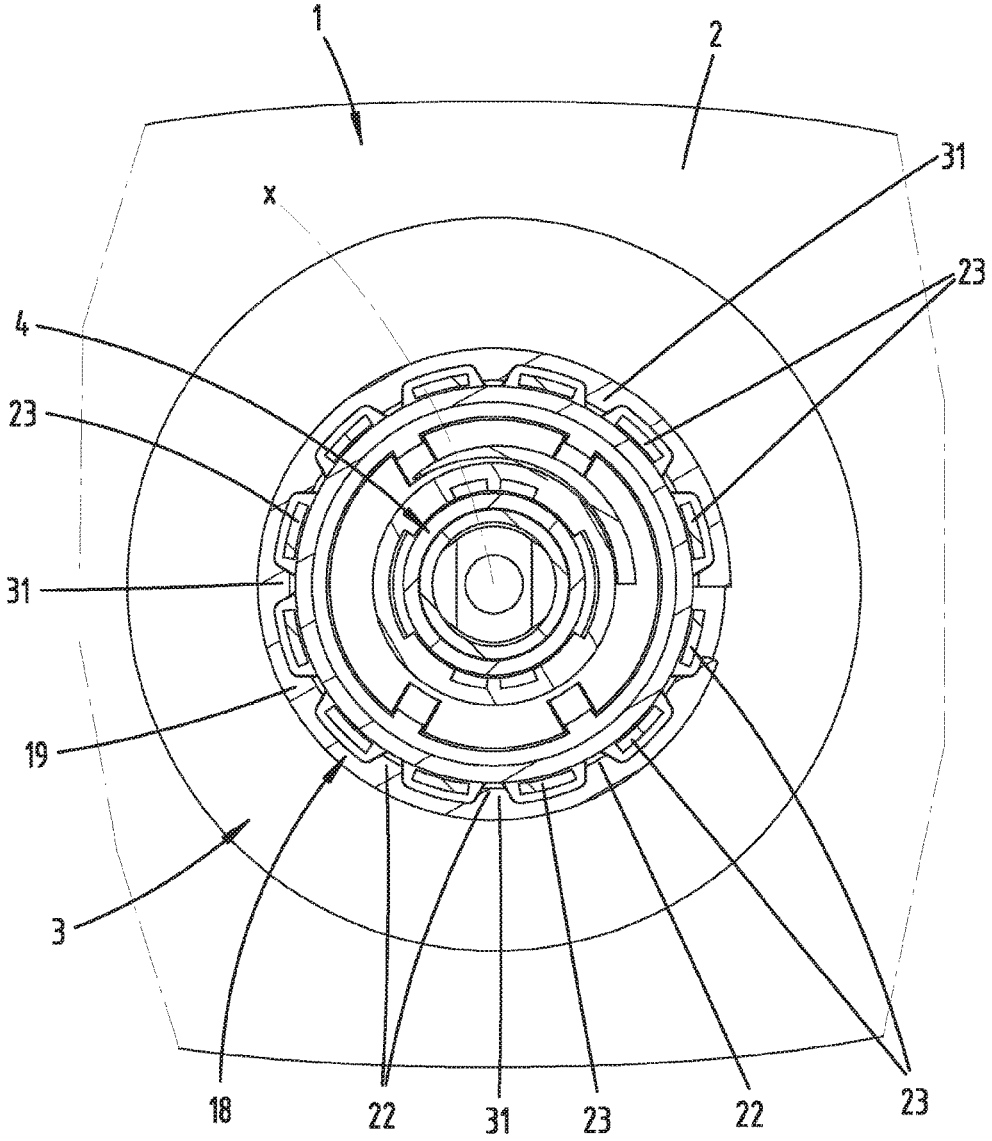
FIG. 6 shows the section along the line VI-VI in FIG. 2.
Figure 7:
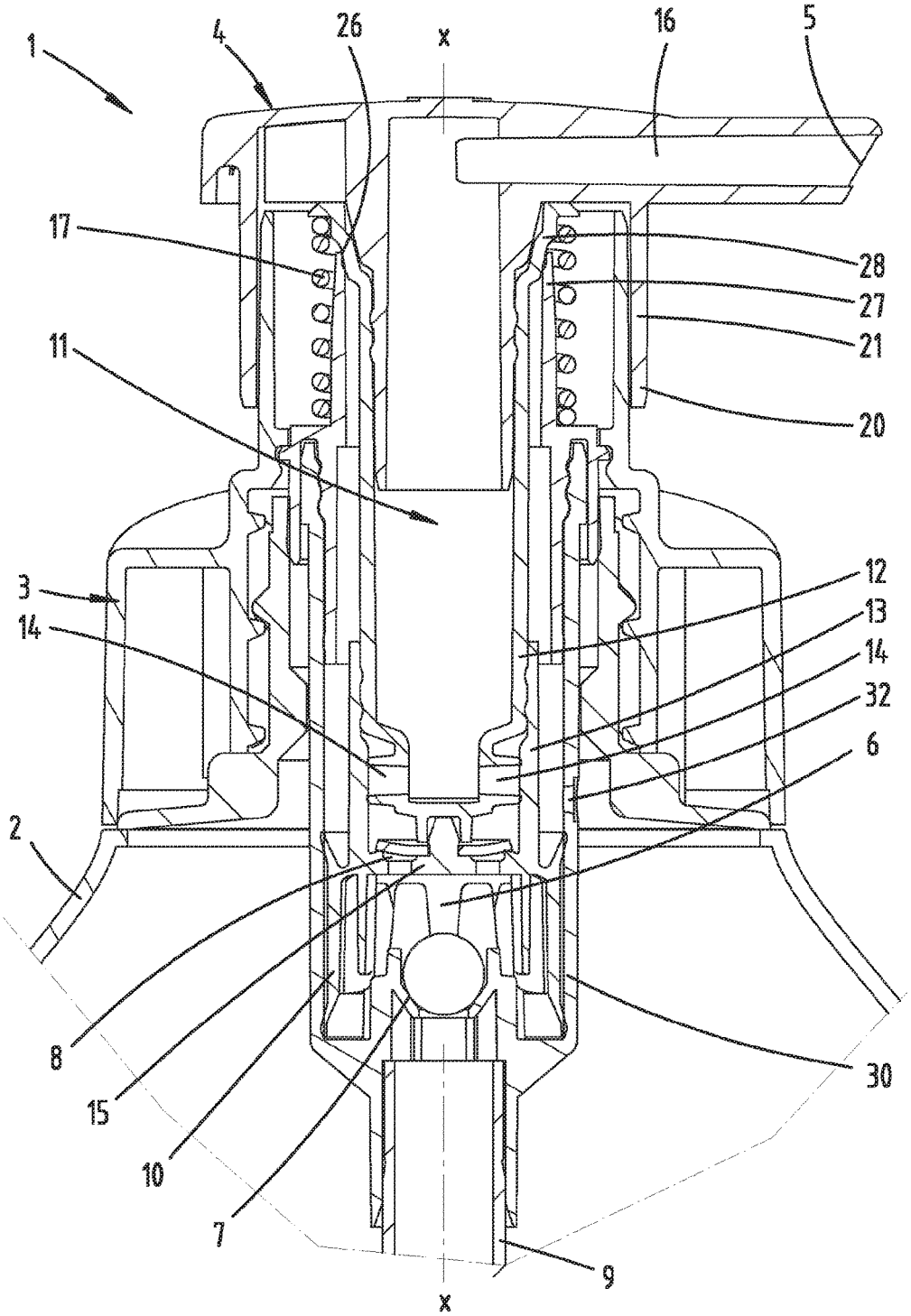
FIG. 7 shows a representation corresponding to FIG. 4, however, after the removal of the tamper-evident seal.
Figure 8:
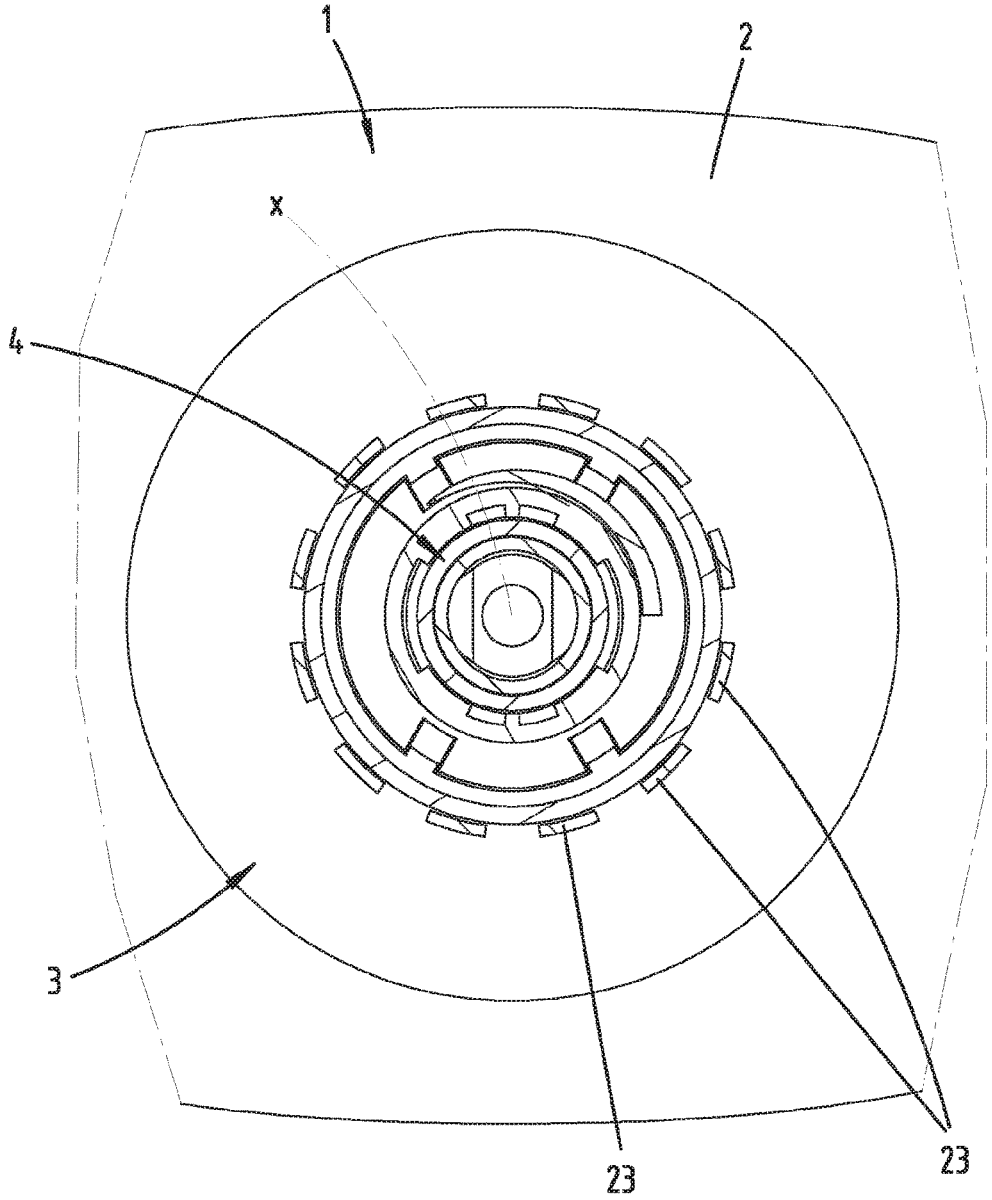
FIG. 8 shows a representation corresponding to FIG. 6, namely also after the removal of the tamper-evident seal.

The flow-through openings 14 of the section 12 are also shut in this closed position as a result of being sealed relative to wall sections of the section 13, which protrude radially inward (see FIG. 4).

Furthermore, a ventilation opening 26 for the container space is closed in the lowered closed position as a result of the circumferential contact of a dispenser body section 27 with an opposite sealing section 28 of the dispenser head 4 similar to a lip seal.

Figure 10:
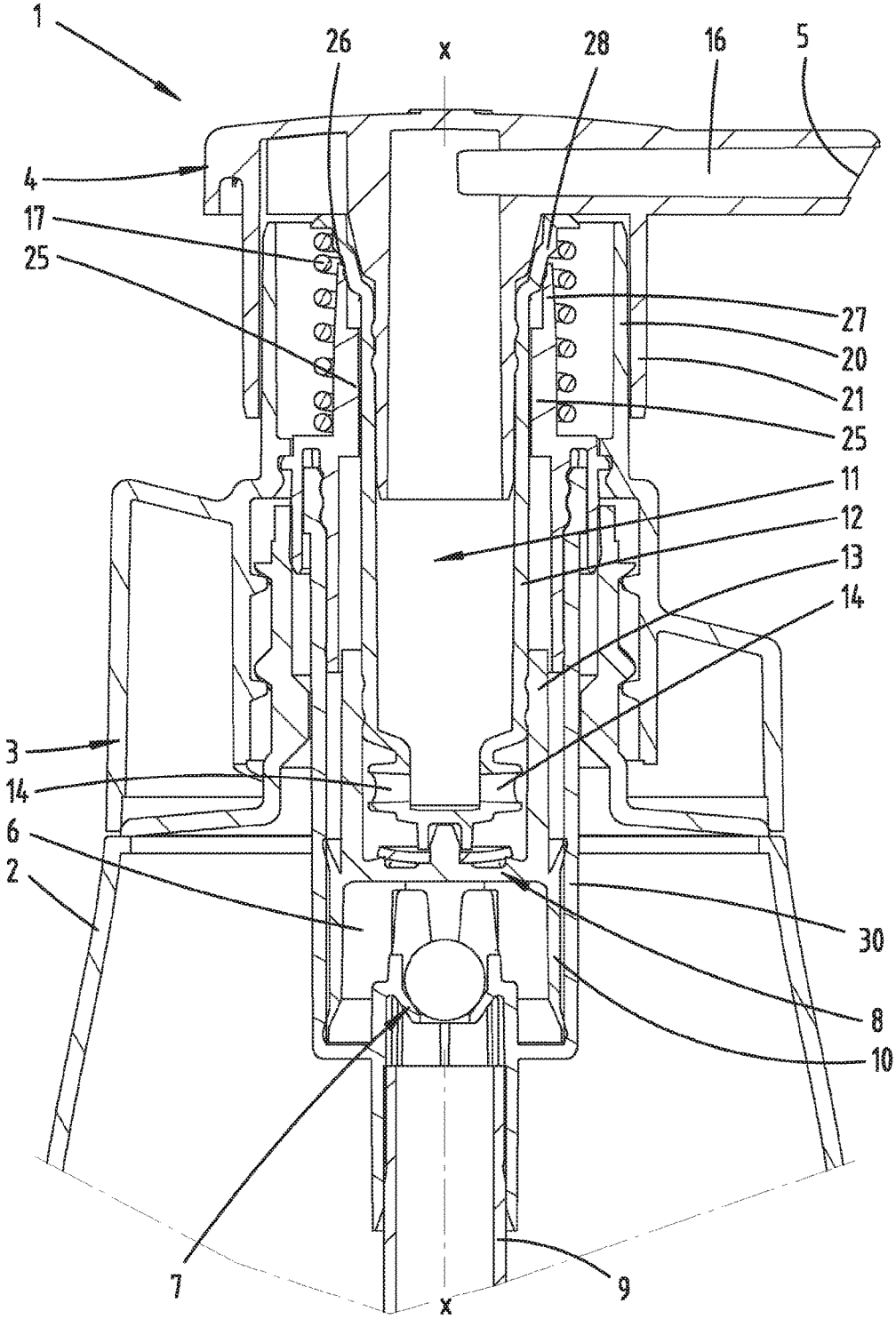
FIG. 10 shows a sectional representation according to FIG. 5, however, concerning the dispenser head position in FIG. 9.
Figure 11:
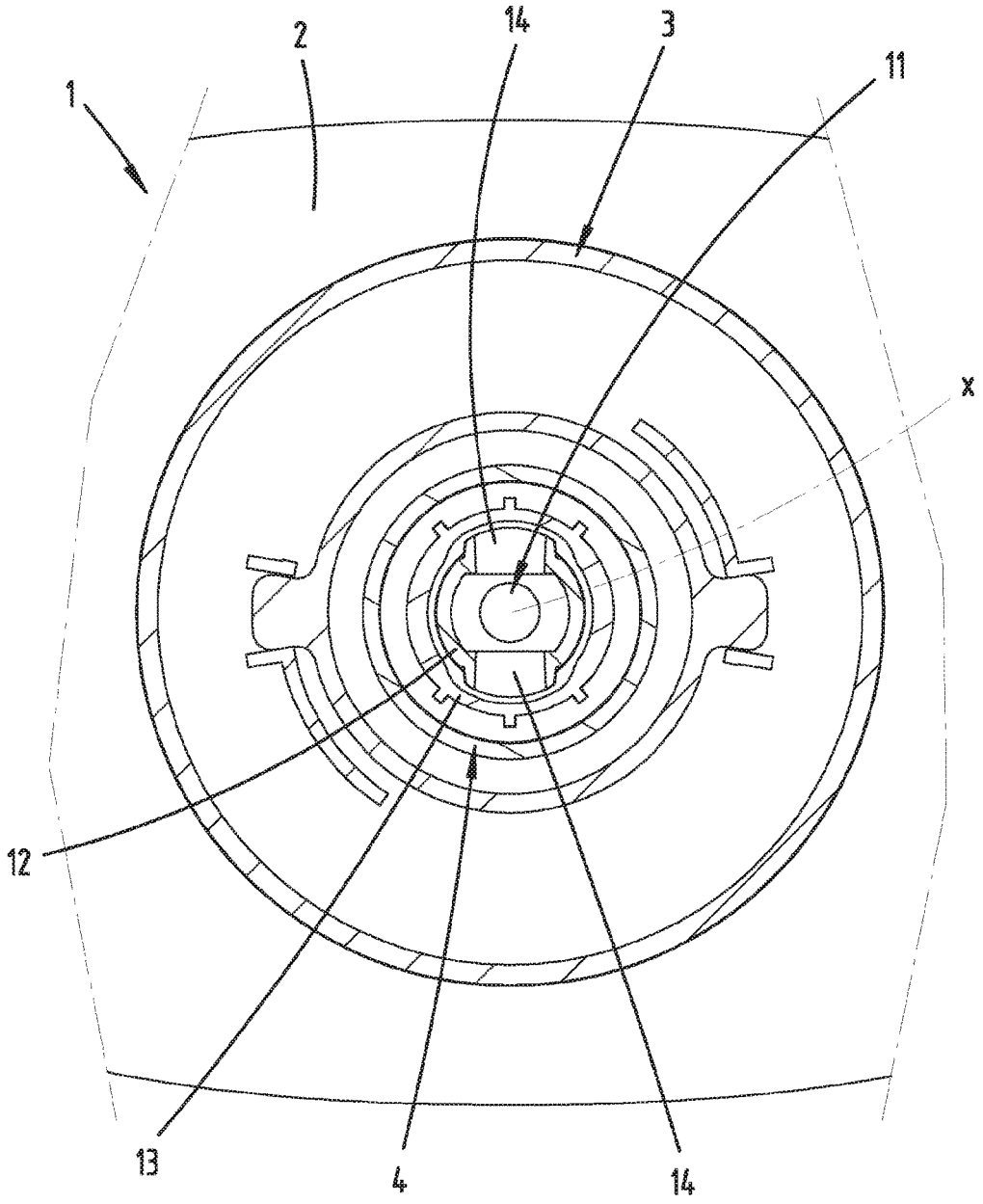
FIG. 11 shows the section along the line XI-XI in FIG. 9.
Figure 15:
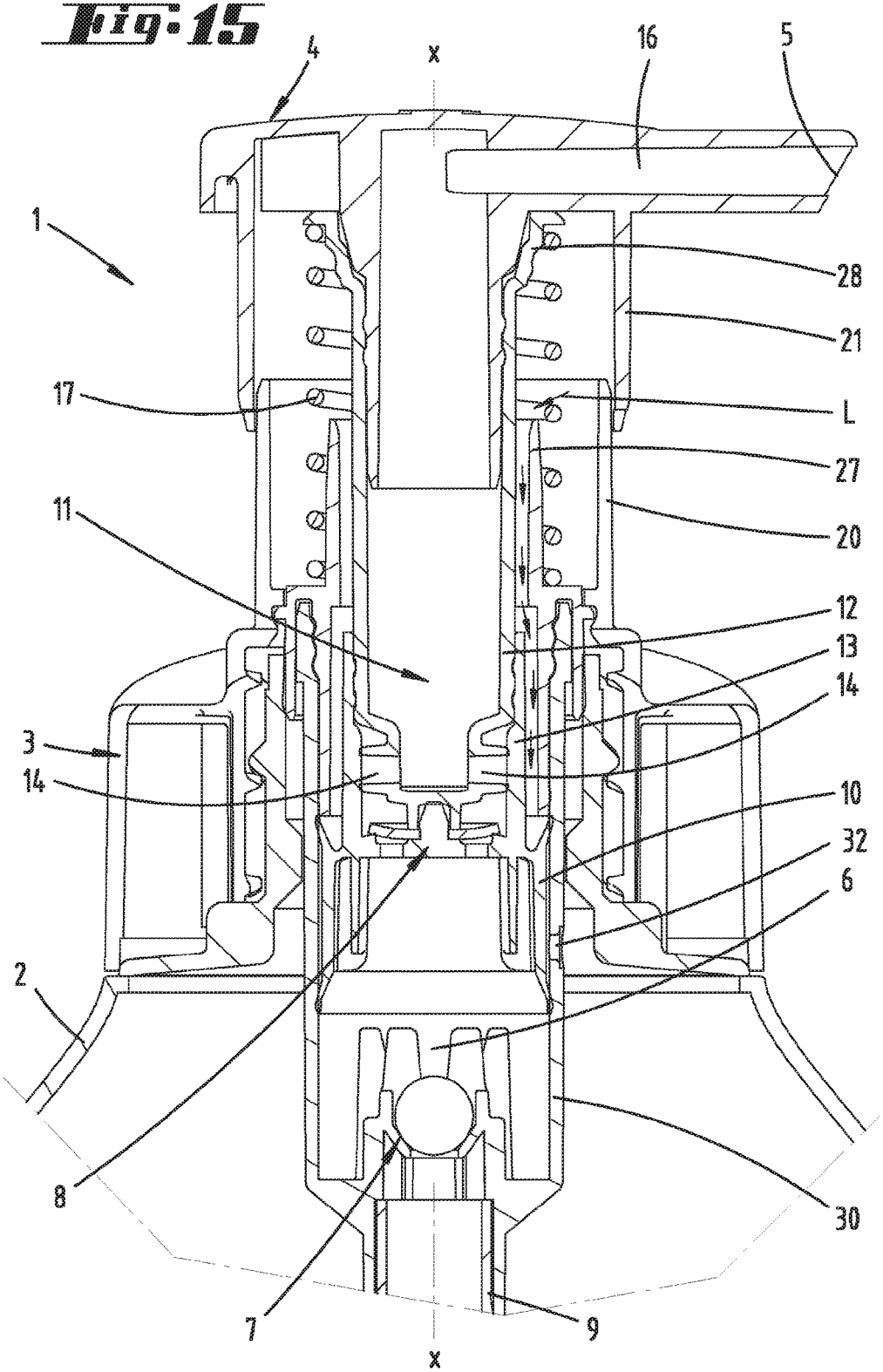
FIG. 15 shows another representation corresponding to FIG. 9, however, with the dispenser head locked in the extended position.
Figure 19:
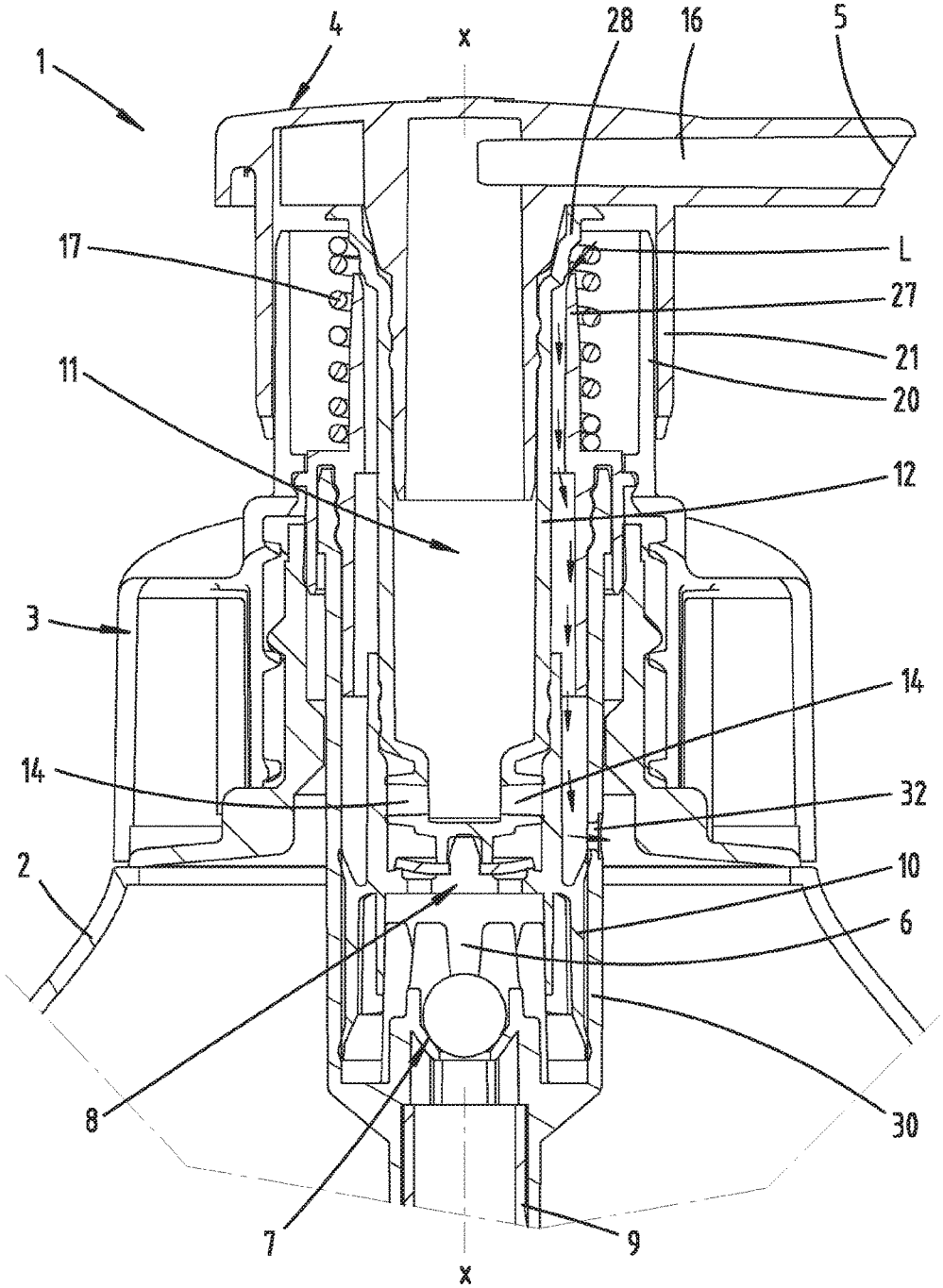
FIG. 19 shows a representation corresponding to FIG. 15, however, concerning an intermediate position of the dispenser head.

In an intermediate position according to FIG. 19 between the extended position illustrated, e.g., in FIG. 15 and a retracted position illustrated, e.g., in FIG. 10, air can be drawn into the interior of the container 2 along an air path L through a ventilation opening 32 in the pump chamber wall 30. This constellation exists during the course of an extension, as well as the retraction. This constellation occurs analogously in the second embodiment according to FIGS. 17 and 18, but is not specifically illustrated.

Figure 9:
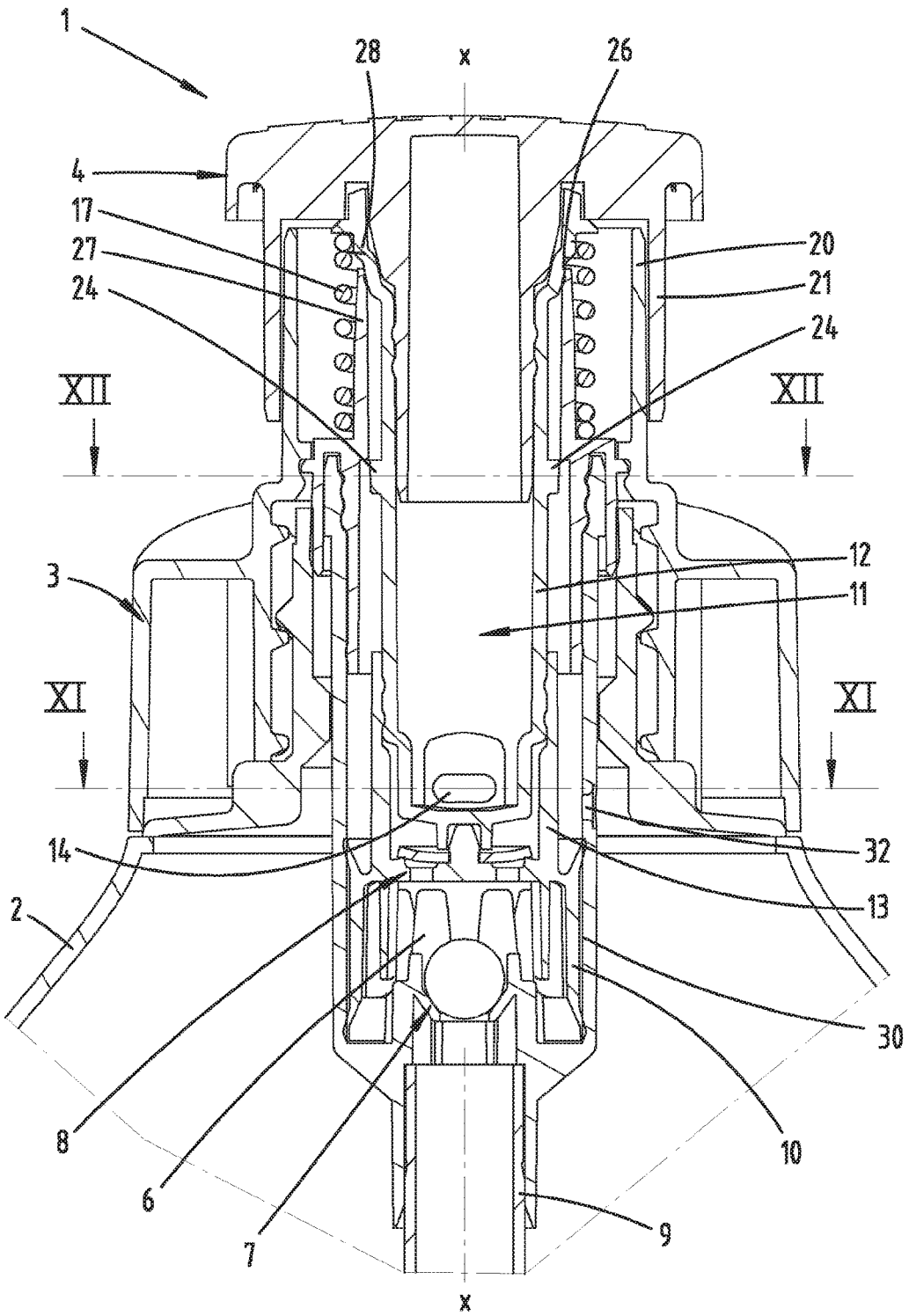
FIG. 9 shows a sectional representation corresponding to FIG. 4 after a rotation of the dispenser head from the closed position into the open position.

The tamper-evident seal can be broken as a result of deliberately rotating the dispenser head 4 from the closed position into the open position according to FIGS. 9 and 10. In the process, the material bridges 22 are torn off the dispenser body 3 by the interlocking recesses 23. The tamper-evident ring 19 can then loosely rest on the dispenser body 3 such that it neither restricts the ability to rotate nor the ability to linearly displace the dispenser head 4.

The tamper-evident ring 19 can also be completely torn off the dispenser body 3 by means of a tab-like handle 29.

The section 12 featuring the flow-through openings 14 is turned relative to the section 13 featuring the pump piston 10 by rotating the dispenser head 4, preferably by 90 degrees, such that the flow-through openings 14 are moved into a flow-through position as illustrated in FIGS. 9 and 10. In this case, the outlets of the flow-through openings 14 are radially spaced apart from the wall section of the section 13. This is achieved, for example, as a result of a material taper of the wall regions of the section 13, which correspond in this position (see FIG. 11).

Figure 12:
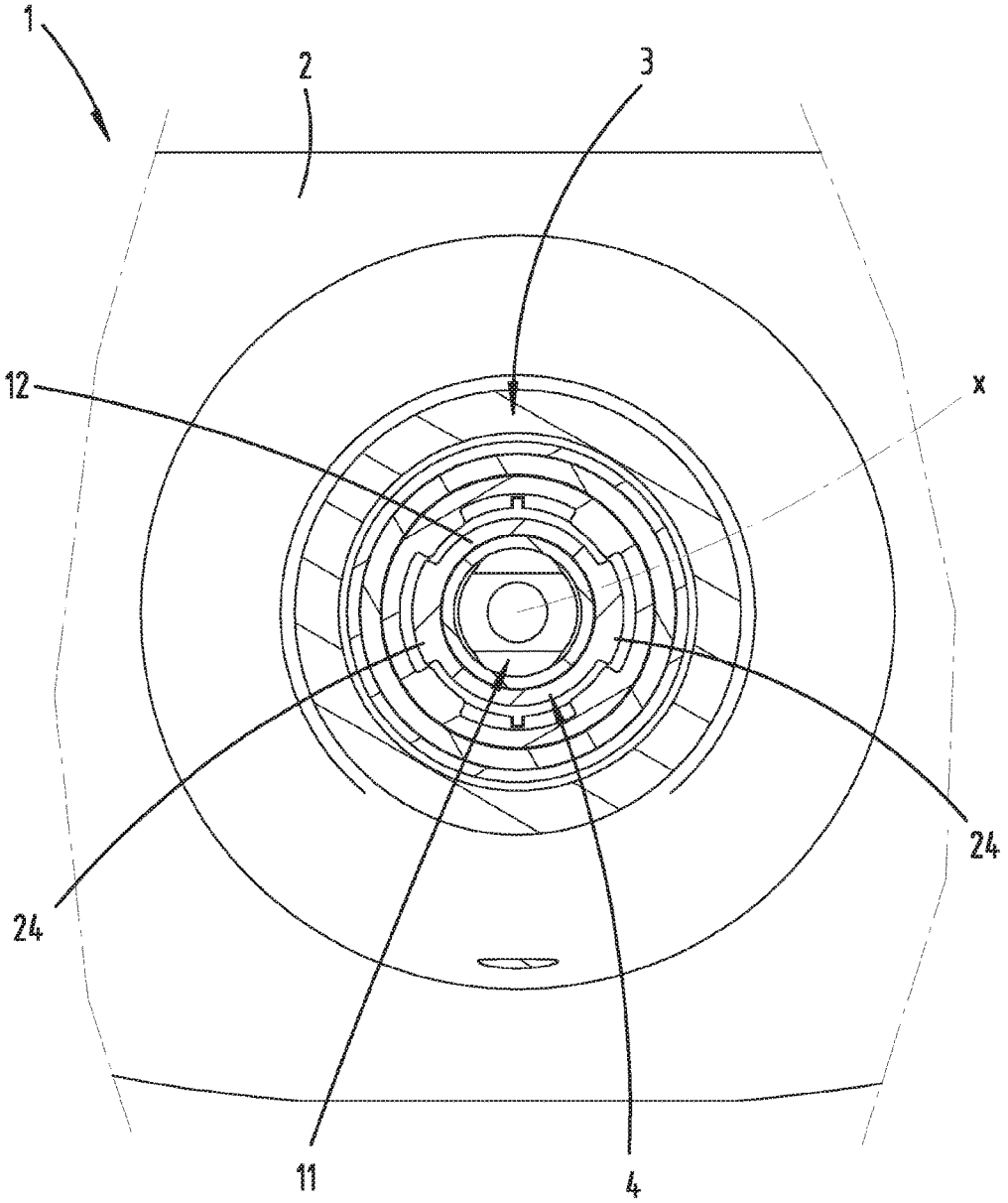
FIG. 12 shows the section along the line XII-XII in FIG. 9.

The locking shoulders 24 of the section 12 are at the same time rotationally displaced into a position, in which they are no longer overlapped by the locking sections 25 on the side of the dispenser body (see FIG. 12).

After its rotation from the closed position into the open position, the dispenser head 4 is spring-loaded in the direction of the extended position by means of the spring 17, wherein the substance is drawn into the pump chamber 6 through the inlet valve 7 during this linear displacement of the dispenser head 4.

In this position, the dispenser 1 is in the usage position. The substance is discharged from the pump chamber 6 through the outlet valve 8 and the flow-through openings 14 and dispensed through the dispensing tube by lowering the dispenser head 4.

The ventilation opening 26 is unblocked in the extended position of the dispenser head 4 such that air can flow into the interior of the container 2 through this ventilation opening between the telescopically cooperating sections of the dispenser body 3 and the dispenser head 4.

Figure 13:
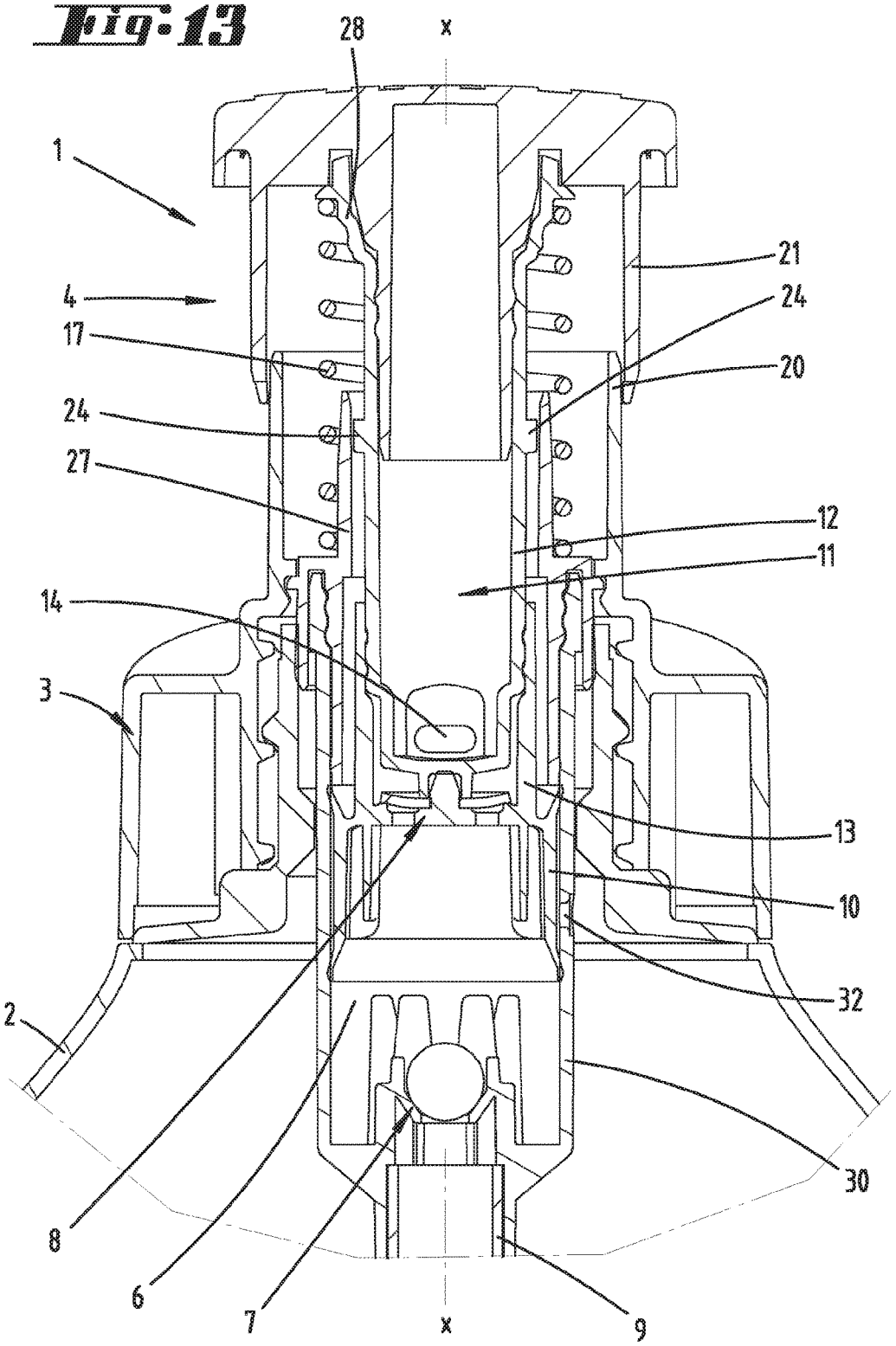
FIG. 13 shows a sectional representation corresponding to FIG. 9, however, with the dispenser head displaced into the extended position.
Figure 14:
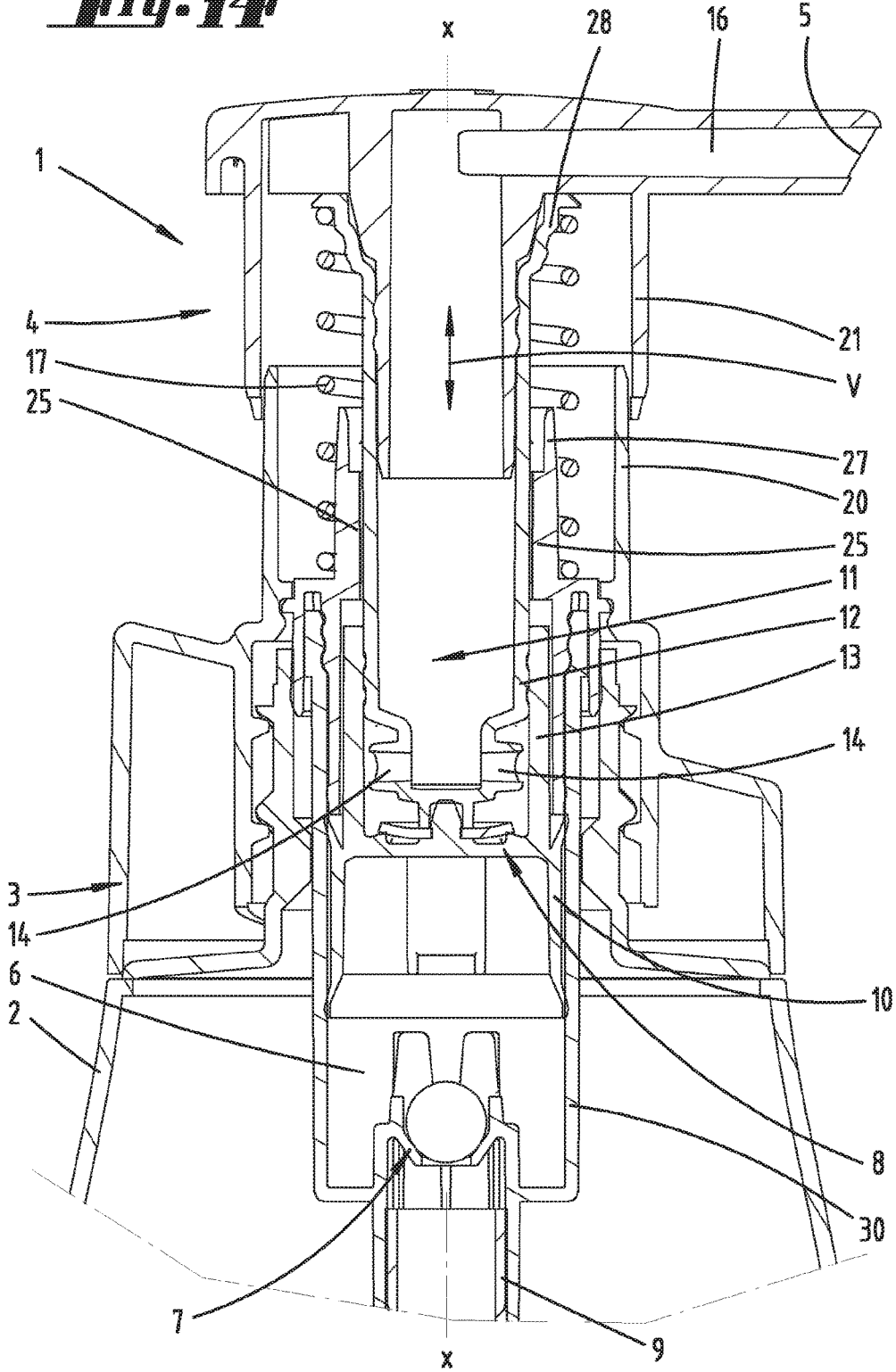
FIG. 14 shows a sectional representation corresponding to FIG. 10 concerning the dispenser head position in FIG. 13.

FIGS. 13 and 14 show the dispenser 1 in the extended position of the dispenser head 4, in which the dispenser is ready for use.

Figure 16:
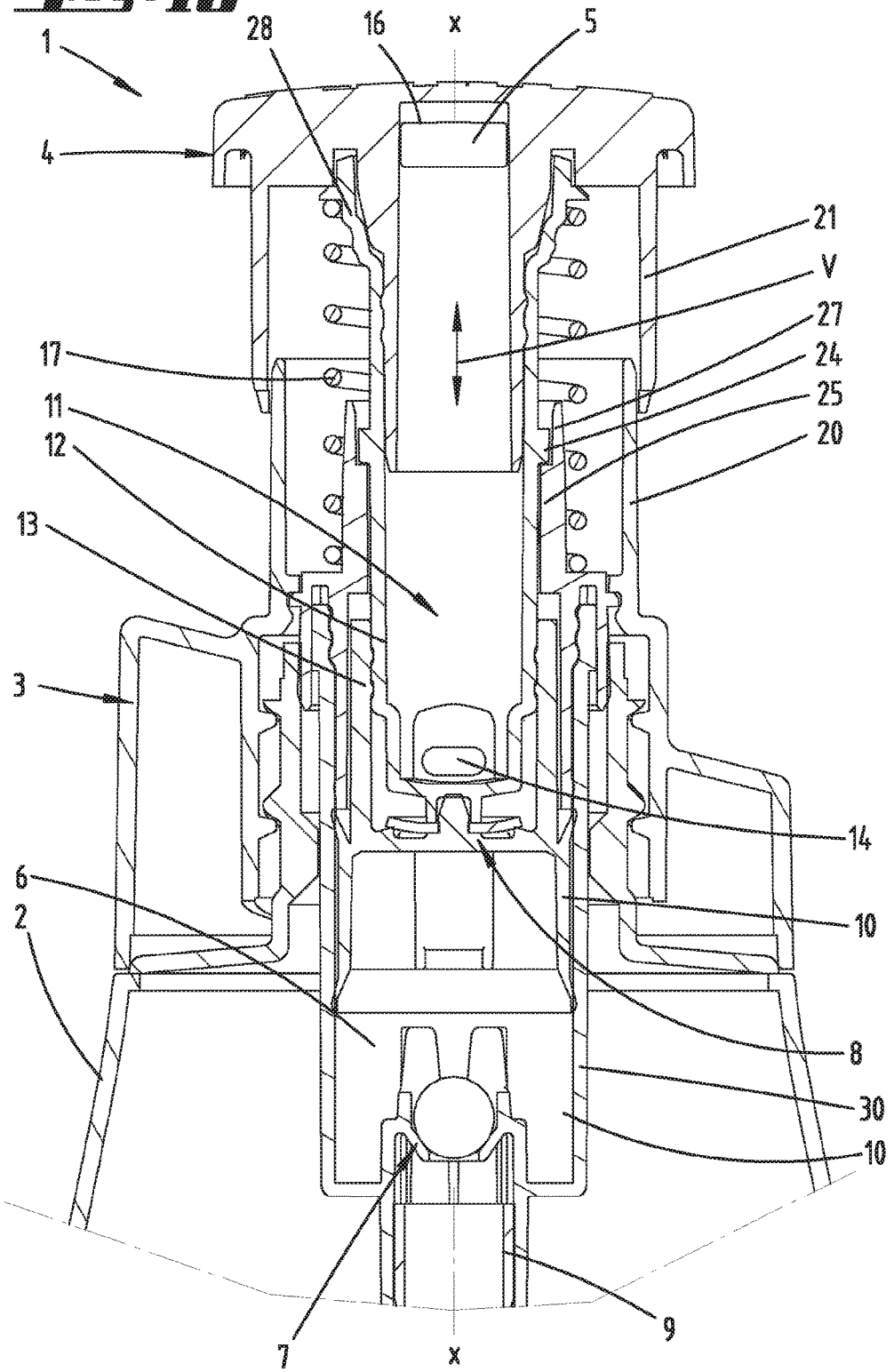
FIG. 16 shows a representation corresponding to FIG. 10 concerning the locked position in FIG. 15.

In this extended position, the dispenser head 4 can also be rotated back into a closed position, particularly for realizing a transport safety. An example of this position is illustrated in FIGS. 15 and 16.

In addition, the flow-through openings 14 are shut in this position as a result of the cooperation with a radially constricted region of the section 13 (see FIG. 15). Furthermore, the axial displacement (pumping motion) of the dispenser head 4 is also prevented in this position as a result of the support of the locking shoulders 24 on the locking sections 25 of the dispenser body 3 (see FIG. 16).

In the embodiment according to FIGS. 17 and 18, the ventilation opening 26 is in the lowered closed position illustrated in these figures formed by an annular groove 33 on the section 12, which cooperates with a corresponding projection 34 on the pump chamber wall 30 that is additionally raised in this region. Furthermore, the same region of the section 12, which is also enlarged in a wing-like fashion in this region and with respect to this cross section, forms an internal receptacle 35 for the spring 17. In the first embodiment, the spring 17 is seated on the underside of the dispenser body section 27 whereas the spring 17 is in the embodiment according to FIGS. 17 and 18 seated on the underside of an internal shoulder of the pump chamber wall 30.

The preceding explanations serve for elucidating all inventions that are included in this application and respectively enhance the prior art independently with at least the following combinations of characteristics, namely:

A dispenser 1, which is characterized in that, when the dispenser 1 rests on a horizontally aligned supporting plane, the sections 12, 13 can be moved relative to one another without a relative motion in a vertical direction in order to change between the closed position and the open position.

A dispenser 1, which is characterized in that the dispenser features a ventilation opening 26 for a reservoir, and in that the ventilation opening 26 is shut in the closed position.

A dispenser 1, which is characterized in that the sections 12, 13 can only be rotationally moved relative to one another in order to change between the closed position and the open position.

A dispenser 1, which is characterized in that the dispenser head 4 can be moved between an extended position and a retracted position in the vertical direction.

A dispenser 1, which is characterized in that the mobility between the extended position and the retracted position is blocked in the closed position.

A dispenser 1, which is characterized in that the closed position can be assumed in the extended position.

A dispenser 1, which is characterized in that the closed position can be assumed in the retracted position.

All disclosed characteristics are essential to the invention (individually, but also in combination with one another). The disclosure content of the associated/attached priority documents (copy of the priority application) is hereby fully incorporated into the disclosure of this application, namely also for the purpose of integrating characteristics of these documents into claims of the present application. The characteristic features of the dependent claims characterize independent inventive enhancements of the prior art, particularly for submitting divisional applications on the basis of these claims.

LIST OF REFERENCE SYMBOLS

1 Dispenser
2 Container
3 Dispenser body
4 Dispenser head
5 Dispensing opening
6 Pump chamber
7 Inlet valve
8 Outlet valve
9 Substance suction tube
10 Pump piston
11 Dispensing tube
12 Section
13 Section
14 Flow-through opening
15 Base
16 Discharge channel
17 Spring
18 Tamper-evident seal
19 Tamper-evident ring
20 Dispenser body neck
21 Dispenser head neck
22 Material bridges
23 Interlocking recess
24 Locking shoulder
25 Locking section
26 Ventilation opening
27 Dispenser body section
28 Opposite sealing section
29 Handle
30 Pump chamber wall
31 Interlocking projection
32 Ventilation opening
33 Annular groove
34 Projection
35 Internal receptacle
L Air path
V Displacement direction
x Dispenser axis

The invention claimed is:

1. A dispenser for liquid to pasty substances with a dispenser head and a dispenser body, wherein the dispenser head is movable relative to the dispenser body in a displacement direction in order to carry out a pumping motion, as well as rotatable relative to the dispenser body, wherein the dispenser furthermore features a pump chamber with a pump piston, an inlet valve and an outlet valve, wherein a dispensing tube is arranged downstream of the outlet valve in a dispensing direction of the substance and said dispensing tube is divided into first and second sections, which can be moved relative to one another and, as a result of a motion relative to one another, transferred into a closed position, in which the substance cannot be dispensed, and into an open position, in which the substance can be dispensed, wherein the first and second sections are nested in one another at regions that face one another in order to form an inner part and an outer part, wherein a seal can be produced between an outer wall of the inner part and an inner wall of the outer part, wherein the first and second sections can be moved relative to one another without a relative motion in the displacement direction in order to change between the closed position and the open position, and wherein the first section includes a bottom side that carries the pump piston and is guided in the pump chamber such that the first section is non-rotatable relative to the dispenser, but displaceable in an axial direction.

2. The dispenser according to claim 1, wherein the dispenser features a ventilation opening for a reservoir and the ventilation opening is shut in the closed position, wherein the ventilation opening is shut as a result of a circumferential contact of a dispenser body section of the dispenser body with an opposite sealing section of the dispenser head.

3. The dispenser according to claim 1, wherein the first and second sections can only be rotationally moved relative to one another in order to change between the closed position and the open position.

4. The dispenser according to claim 1, wherein the dispenser head is configured to be moved between an extended position and a retracted position in the displacement direction.

5. The dispenser according to claim 4, wherein the closed position is achieved in the extended position.

6. The dispenser according to claim 4, wherein the closed position is achieved in the retracted position.

7. The dispenser according to claim 1, wherein mobility between an extended position of the dispenser head and a retracted position of the dispenser head is blocked in the closed position.

8. A dispenser for liquid to pasty substances with a dispenser head and a dispenser body, wherein the dispenser head is movable relative to the dispenser body in a displacement direction in order to carry out a pumping motion, as well as rotatable relative to the dispenser body, wherein the dispenser furthermore features a pump chamber with a pump piston, an inlet valve and an outlet valve, wherein a dispensing tube is arranged downstream of the outlet valve in a dispensing direction of the substance and said dispensing tube is divided into first and second sections, which can be moved relative to one another and, as a result of a motion relative to one another, transferred into a closed position, in which the substance cannot be dispensed, and into an open position, in which the substance can be dispensed, wherein the first and second sections are nested in one another at regions that face one another in order to form an inner part and an outer part, wherein a seal can be produced between an outer wall of the inner part and an inner wall of the outer part, wherein the dispenser features a ventilation opening for a reservoir and the ventilation opening is shut in the closed position, and wherein the ventilation opening is shut as a result of a circumferential contact of a section of the dispenser body with an opposite sealing section of the dispenser head.

* * * * *